US010810960B2

(12) United States Patent
Matsuishi

(10) Patent No.: US 10,810,960 B2
(45) Date of Patent: Oct. 20, 2020

(54) DISPLAY DEVICE

(71) Applicant: SHARP KABUSHIKI KAISHA, Sakai, Osaka (JP)

(72) Inventor: Takuya Matsuishi, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 44 days.

(21) Appl. No.: 16/467,380

(22) PCT Filed: Aug. 23, 2017

(86) PCT No.: PCT/JP2017/030191
§ 371 (c)(1),
(2) Date: Jun. 6, 2019

(87) PCT Pub. No.: WO2018/105172
PCT Pub. Date: Jun. 14, 2018

(65) Prior Publication Data

US 2019/0333462 A1 Oct. 31, 2019

(30) Foreign Application Priority Data

Dec. 8, 2016 (JP) ..... 2016-238876

(51) Int. Cl.
*G09G 3/36* (2006.01)

(52) U.S. Cl.
CPC ..... *G09G 3/3666* (2013.01); *G09G 2310/04* (2013.01); *G09G 2320/0261* (2013.01); *G09G 2330/024* (2013.01); *G09G 2360/10* (2013.01)

(58) Field of Classification Search
None
See application file for complete search history.

(56) References Cited

U.S. PATENT DOCUMENTS

| | | | | |
|---|---|---|---|---|
| 2004/0130553 | A1 | 7/2004 | Canon | |
| 2005/0058425 | A1 | 3/2005 | Berini et al. | |
| 2010/0231800 | A1 * | 9/2010 | White | G09G 3/2022 348/663 |

FOREIGN PATENT DOCUMENTS

| | | | |
|---|---|---|---|
| JP | 2006-139803 | A | 6/2006 |
| JP | 2012-520606 | A | 9/2012 |

* cited by examiner

*Primary Examiner* — Ifedayo B Iluyomade
(74) *Attorney, Agent, or Firm* — ScienBiziP, P.C.

(57) ABSTRACT

The present invention provides a display device (smartphone (3)) that realizes less power consumption for refreshing a video. The smartphone (3) includes: a host (2) configured to obtain image data which is to be supplied to an LCD panel (31); and a driver (32) configured to transmit, to the LCD panel (31), the image data so as to refresh a video which is displayed by the display panel, the driver (32) being configured to refresh a video, displayed on an extended region (312), at a refresh rate lower than that at which the driver (32) refreshes data displayed on a main region (311).

5 Claims, 6 Drawing Sheets

DISPLAY DEVICE

TECHNICAL FIELD

An aspect of the present invention relates to a display device that reduces power consumption of a display panel.

BACKGROUND ART

Display devices for displaying a video have been widely used. In general, a display device updates (refreshes) a video to be displayed at a predetermined refresh rate.

CITATION LIST

Patent Literature

[Patent Literature 1]
Japanese Patent Application Publication Tokukai No. 2006-139803 (Publication Date: Jun. 1, 2006)

SUMMARY OF INVENTION

Technical Problem

According to the conventional technique, an entire display screen is refreshed at a time. Note, however, that, under some circumstances, contents, which are displayed on a screen, may include a region that is less frequently refreshed. In such circumstances, there is sometimes no difference, in such a region, between before and after refreshing. For example, in some terminal devices such as a smartphone, an extended region is secured in a display section so that time or other information is displayed thereon. In a case where a video is played back on such a terminal device, an entire display region of the terminal device, inclusive of (i) the region where the video is being played and (ii) the extended region, is refreshed at a predetermined refresh rate (e.g., 60 times per second), irrespective of contents, which are displayed on the extended region, being changed once a minute.

In other words, according to the conventional technique, a video is needlessly refreshed in the region where the contents are refreshed at a low refresh rate. If such a waste is reduced, then power consumption is reduced. This allows the display device to reduce power consumption. Note that Patent Literature 1 discloses an image processing apparatus that carries out appropriate image processing in accordance with an image processing mode (e.g., a copying mode and a scanning mode), by causing rectangular regions, into which image data is divided and allocated, to be different from each other in accordance with the image processing mode. Note, however, that the image processing apparatus of Patent Literature 1 is not directed to a power saving but to appropriate image processing.

An object of an aspect of the present invention is to provide, for example, a display device that realizes less power consumption for refreshing a video displayed on a display panel, in comparison with conventional techniques.

Solution to Problem

In order to solve the aforementioned problem, a display device in accordance with an aspect of the present invention includes: a display panel; an obtaining section configured to obtain image data which is to be supplied to the display panel; and a display processing section configured to transmit, to the display panel, the image data obtained by the obtaining section so as to refresh a video which is displayed by the display panel, the display processing section being configured to refresh a video, displayed on a partial region of the display panel, at a refresh rate lower than that at which the display processing section refreshes data displayed on a region other than the partial region.

Advantageous Effects of Invention

An aspect of the present invention can bring about an effect of reducing power consumption for refreshing a video, in comparison with a configuration in which each and every region of the display panel are refreshed at the same refresh rate.

DESCRIPTION OF EMBODIMENTS

Embodiment 1

(Configuration of Smartphone)

Figure 1:
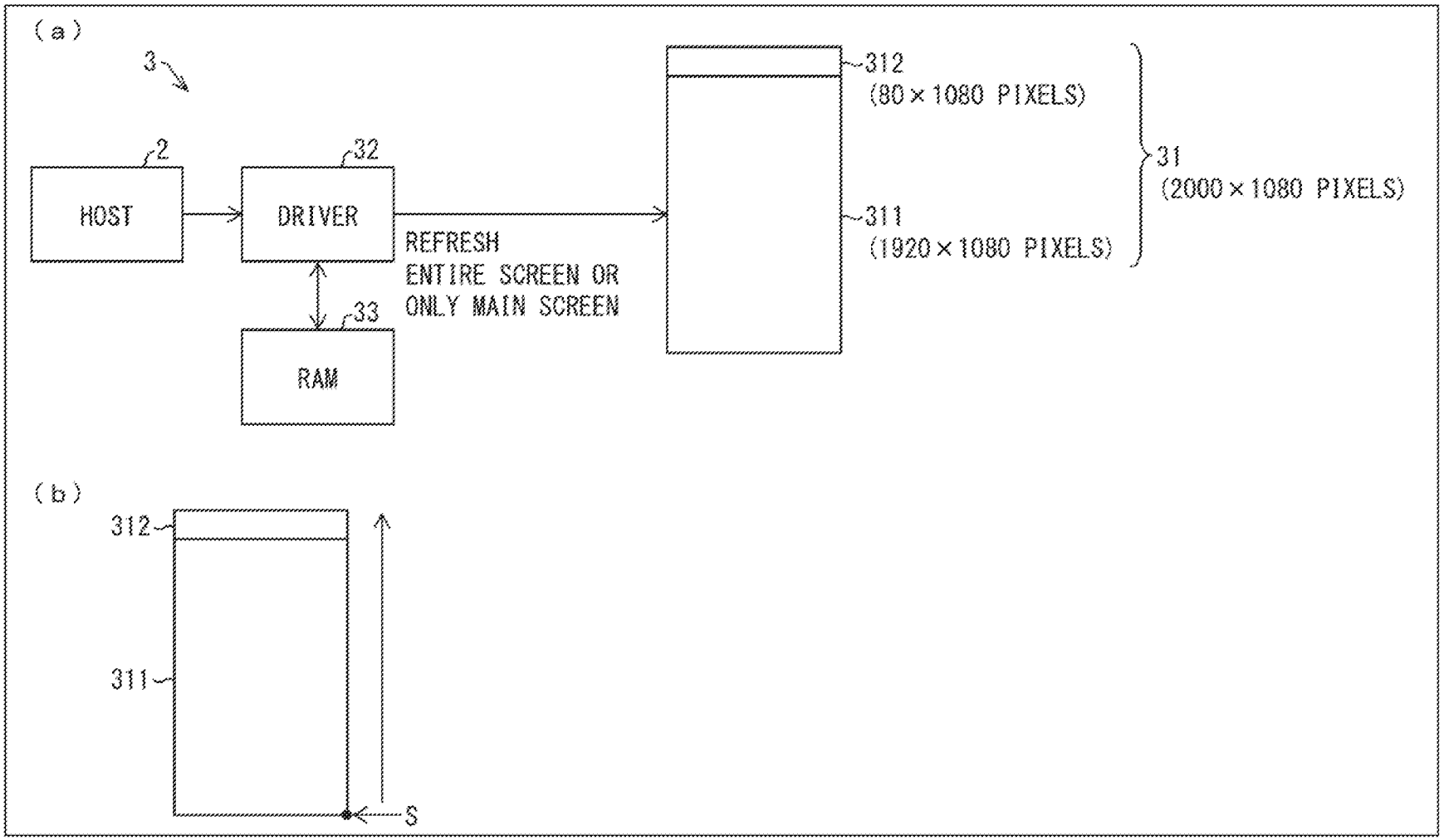
FIG. 1 is an explanatory block diagram illustrating a configuration of a smartphone in accordance with Embodiment 1 of the present invention.

FIG. 1 is a block diagram illustrating a configuration of a smartphone 3 (display device) in accordance with Embodiment 1 of the present invention. As illustrated in (a) of FIG. 1, the smartphone 3 includes a liquid crystal display (LCD) panel 31 (display panel). The smartphone 3 further includes a cabinet in which there are provided a host 2 (obtaining section), a driver 32 (display processing section), and a random-access memory (RAM) 33 (storage section).

The host 2 obtains image data to be supplied to the LCD panel 31. The driver 32 transmits the image data to the LCD panel 31 so that the LCD panel 31 displays a video or refreshes the video thus displayed. The RAM 33 is provided for the driver 32 and is configured to store therein image data transferred from the host 2 to the driver 32. The RAM 33 can be incorporated in the driver 32.

The driver 32 controls the LCD panel 31 to display and refresh a video. According to the example of Embodiment 1, the LCD panel 31 includes pixels each having a semiconductor layer composed of oxide semiconductor. IGZO (InGaZnOx) is employed as the oxide semiconductor. Note that the IGZO (InGaZnOx) belongs to InGaZnO oxide semiconductor.

As illustrated in (a) and (b) of FIG. 1, a display region of the LCD panel 31 includes a main region 311 (a region other than a partial region) and an extended region 312 (partial region). The main region 311 is a main region for displaying various types of image data which are obtained by or stored in the smartphone 3. For example, a full high-definition (FHD) video (1920 pixels×1080 pixels) is displayed on the main region 311. Meanwhile, the extended region 312 is located just above the main region 311 so as to be located at an upper end of the LCD panel 31. For example, an image, whose content is less frequently changed, is displayed on the extended region 312 than on the main region 311. For example, an image indicative of time or an image indicative of a remaining battery level of the smartphone 3 is displayed on the extended region 312.

In a case where the driver 32 refreshes a video displayed on the LCD panel 31, the driver 32 refreshes (i) an entire screen (inclusive of both the main region 311 and the extended region 312) or (ii) only a main screen (main region 311) (note that detail will be later described). In other words, the driver 32 continuously refreshes videos displayed on the main region 311, but refreshes a video displayed on the extended region 312 intermittently (only when the entire screen is refreshed). A video, displayed on the LCD panel 31, can be partially refreshed, by employing, for example, a configuration in which (i) the screen of the LCD panel 31 is refreshed in a region extended from a location S at a lower right corner to a location where the main region 311 and extended region 312 are adjacent to each other (see (b) of FIG. 1) but (ii) the screen is not refreshed in the extended region 312. This causes a reduction in refresh rate of the video displayed on the extended region 312. This ultimately allows a reduction in power consumption of the LCD panel 31, in comparison with a conventional configuration in which an entire screen is continuously refreshed.

In the LCD panel 31, drawing starts at the location S which is located at the lower right corner of the screen (see (b) of FIG. 1). As such, in a case where the entire screen (i.e., both the main region 311 and the extended region 312) of the LCD panel 31 is refreshed, the refreshing starts at the position S. After the main region 311 is entirely refreshed, the extended region 312 is refreshed. As is clear from this, it can be also said that the main region 311 is located between the location S and the extended region 312.

(Operation of Smartphone 3)

Figure 2:
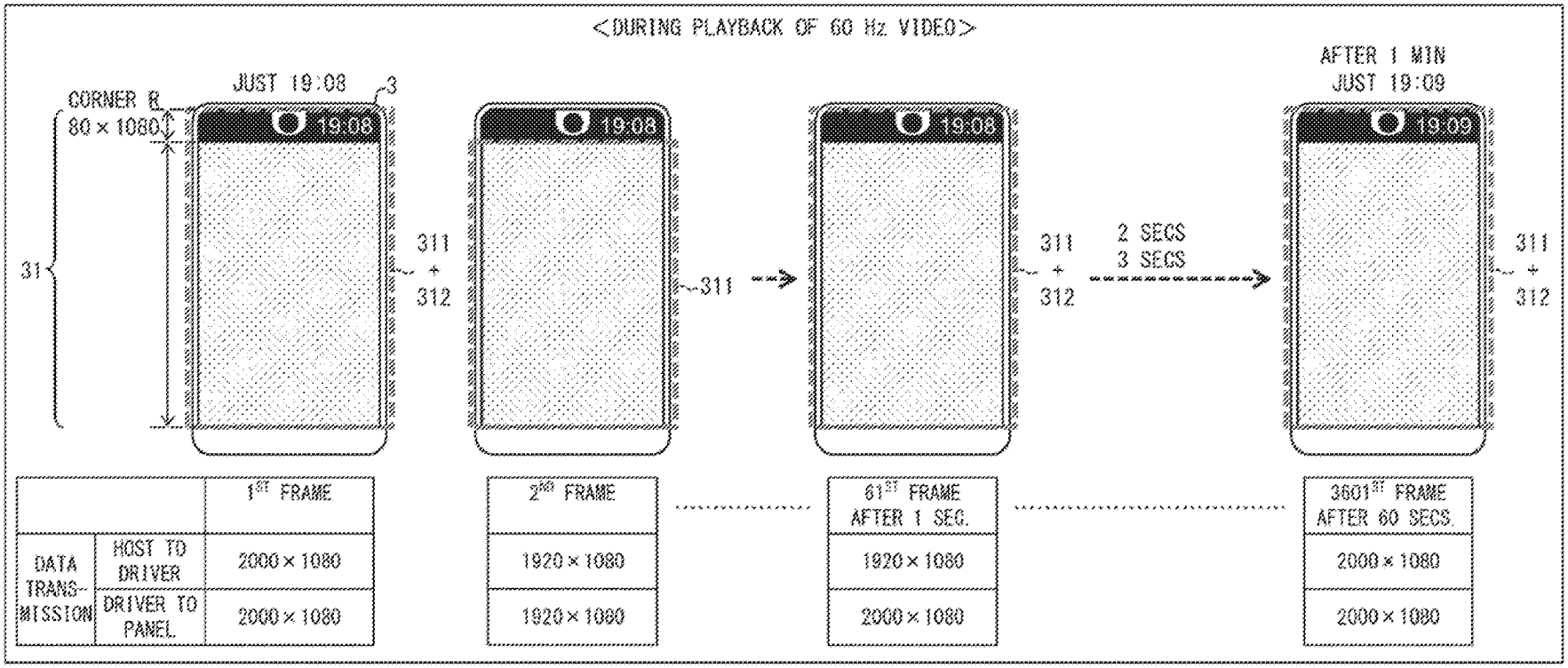
FIG. 2 is a view illustrating an example operation of the smartphone.

FIG. 2 is an explanatory view illustrating an example operation of the smartphone 3. This example illustrates, during one minute from 19:08 to 19:09, (i) data transmitted from the host 2 to the driver 32 and (ii) data transmitted from the driver 32 to the LCD panel 31. Note that what is displayed on the extended region 312 is a video of a clock indicating time that changes in increments of one minute. This means that content of a video displayed on the extended region 312 is refreshed once a minute. Note also that videos displayed in the main region 311 are refreshed 60 times per second (i.e., a 60 Hz video).

Note also that a display size of the main region 311 is set to 1920×1080 pixels, and a display size of the extended region 312 is set to 80×1080 pixels. This means that a display size of the entire LCD panel 31 is set to 2000×1080 pixels. Therefore, in the case where the entire screen (inclusive of the regions 311 and 312) is refreshed, 2000×1080-pixel video data (hereinafter referred to as "entire screen data") is transferred to the LCD panel 31. In a case where only the main region 311 is refreshed, 1920×1080-pixel video data (hereinafter referred to as "partial screen data") is transferred to the LCD panel 31.

(First Frame)

The host 2 obtains entire screen data from a source of a video to be displayed, and then transmits the entire screen data to the driver 32. The driver 32 stores the entire screen data in the RAM 33, and then transfers, to the LCD panel 31, the entire screen data thus stored. This causes (i) the entire screen of the LCD panel 31 to be refreshed; (ii) the clock, displayed on the extended region 312, to show "19:08," and (iii) a first frame of a video to be displayed on the main region 311.

(Second Through 60th Frames)

In a second frame, the host 2 obtains partial screen data. The host 2 thus obtains partial screen data or entire screen data on a frame basis (at a predetermined cycle). Since the host 2 obtains, in the second frame, the partial screen data as described above, the data to be transmitted to the driver 32 is switched to the partial screen data. The driver 32 transfers the partial screen data received to the LCD panel 31. In this way, the driver 32 sequentially transmits, to the LCD panel, the partial screen data or entire screen data received from the host 2. This causes only a video, displayed on the main region 311 of the LCD panel 31, to be refreshed. Consequently, the second frame of the video is displayed on the main region 311. In contrast, the first frame of the video keeps to be displayed on the extended region 312.

The third through 60th frames of the video are displayed in a manner similar to the second frame. The host 2 transmits partial screen data to the driver 32, and then the driver 32 transfers, to the LCD panel 31, the partial screen data thus received. This causes only a video, displayed on the main region 311 of the LCD panel 31, to be refreshed. The third through 60th frames of the video are successively displayed on the main region 311. The host 2 thus obtains partial screen data in a period of time in which a video, displayed on the extended region 312, is not changed.

(61st Frame (One Second after Disclosed Time))

As in the processes for the second through 60th frames, the host 2 transmits partial screen data to the driver 32. The driver 32 (*a*) transfers, to the main region 311 of the LCD panel 31, the partial screen data thus received and (b) transfers, to the extended region 312 of the LCD panel 31, a part of the entire screen data, which part (i) was received during the process for the first frame, (ii) was stored in the RAM 33, and (iii) corresponds to the extended region 312. This causes the entire screen of the LCD panel 31 to be refreshed.

Note that the entire screen is refreshed in the 61st frame in which a video displayed on the extended region 312 is not changed. This intends to prevent the LCD panel 31 from being burnt in. Specifically, it is preferable to refresh the entire screen at such a certain cycle that at least the LCD panel 31 is not burnt in, regardless of the refresh rate at which the content of a video displayed on the extended region 312 is refreshed. In other words, in a case where the host 2 obtains partial screen data after a predetermined period of time has elapsed from previous refreshing of a video displayed on the extended region 312, it is preferable that the driver 32 refreshes a video with use of entire screen data stored in the RAM 33. In Embodiment 1, the predetermined period of time is set to one second (60 frames) but can be set to an appropriate one in consideration of characteristics of the LCD panel 31 and/or the like.

(62nd Through 3600th Frames)

Processes similar to those for the second through 61st frames are performed with respect to 62nd through 3600th frames. That is, the host 2 transmits partial image data, and the driver 32 transfers the data to the LCD panel 31 so as to refresh a video displayed on the main region 311. The driver 32 further refreshes the entire screen every second (every 60 frames) with use of data stored in the RAM 33.

(3601st Frame)

In a 3601st frame, content of a video displayed on the extended region 312 is refreshed (the clock shows "19:09").

Thus, the host 2 transmits entire screen data to the driver 32. The host 2 thus obtains entire screen data at a timing at which the content of the video displayed on the extended region 312 is changed. The driver 32 transfers, to the LCD panel 31, the entire screen data thus received. This causes the entire screen of the LCD panel 31 to be refreshed, so that (i) the clock shows "19:09" in the extended region 312 and (ii) the 3601st frame of the video is displayed on the main region 311.

Effects of Embodiment 1

With the above configuration, (i) a video displayed on the main region 311 is refreshed on a frame basis (every 1/60 second) and (ii) a video displayed on the extended region 312 is refreshed on a basis of 60 frames (every second). This makes it possible to keep, to the minimum, a refresh rate for the extended region 312. It is therefore possible to reduce power consumption of the LCD panel 31, in comparison with a configuration in which an entire screen is refreshed in synchronization with the refresh rate at which the main region 311 is refreshed.

Furthermore, the host 2 has only to transmit entire screen data every minute. Note that the content of a video, displayed on the extended region 312, is refreshed every minute. During the other period of time, the host 2 has only to transmit partial screen data. This allows a reduction in volume of data to be transmitted by the host 2 as well.

Embodiment 2

The following description will discuss Embodiment 2 of the present invention. In Embodiment 2, members having identical functions as those of Embodiment 1 are given identical reference numerals, and their description will be omitted.

Figure 3:
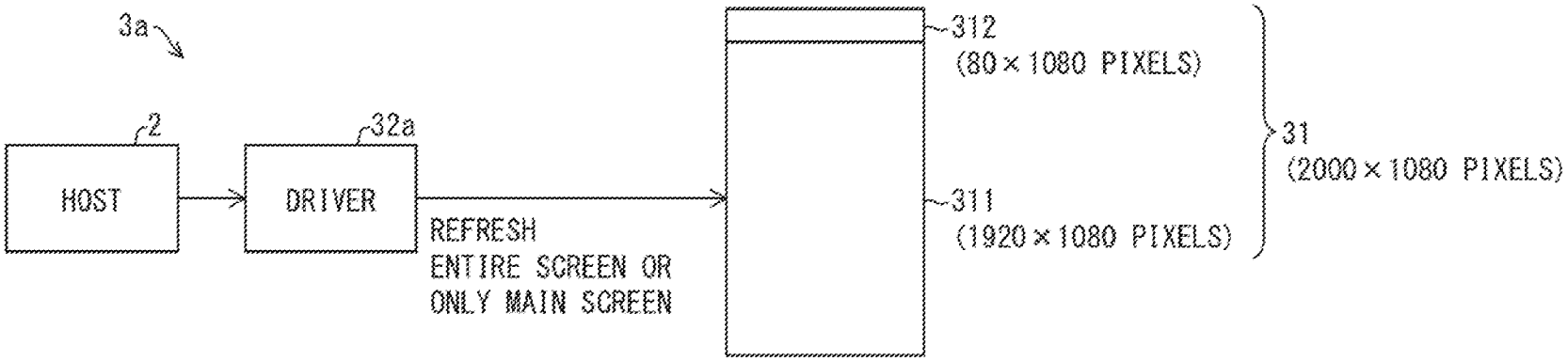
FIG. 3 is an explanatory block diagram illustrating a configuration of a smartphone in accordance with Embodiment 2 of the present invention.

FIG. 3 is a block diagram illustrating a configuration of a smartphone 3*a* of Embodiment 2. The smartphone 3*a* of Embodiment 2 differs from that of Embodiment 1 in that a RAM 33 for use in a driver 32*a* is not provided. Since the smartphone 3*a* of Embodiment 2 does not include the RAM 33 for use in the driver 32*a*, the driver 32*a* transfers data, received from a host 2, directly to an LCD panel 31 to refresh a video.

(Operation of Smartphone 3)

Figure 4:
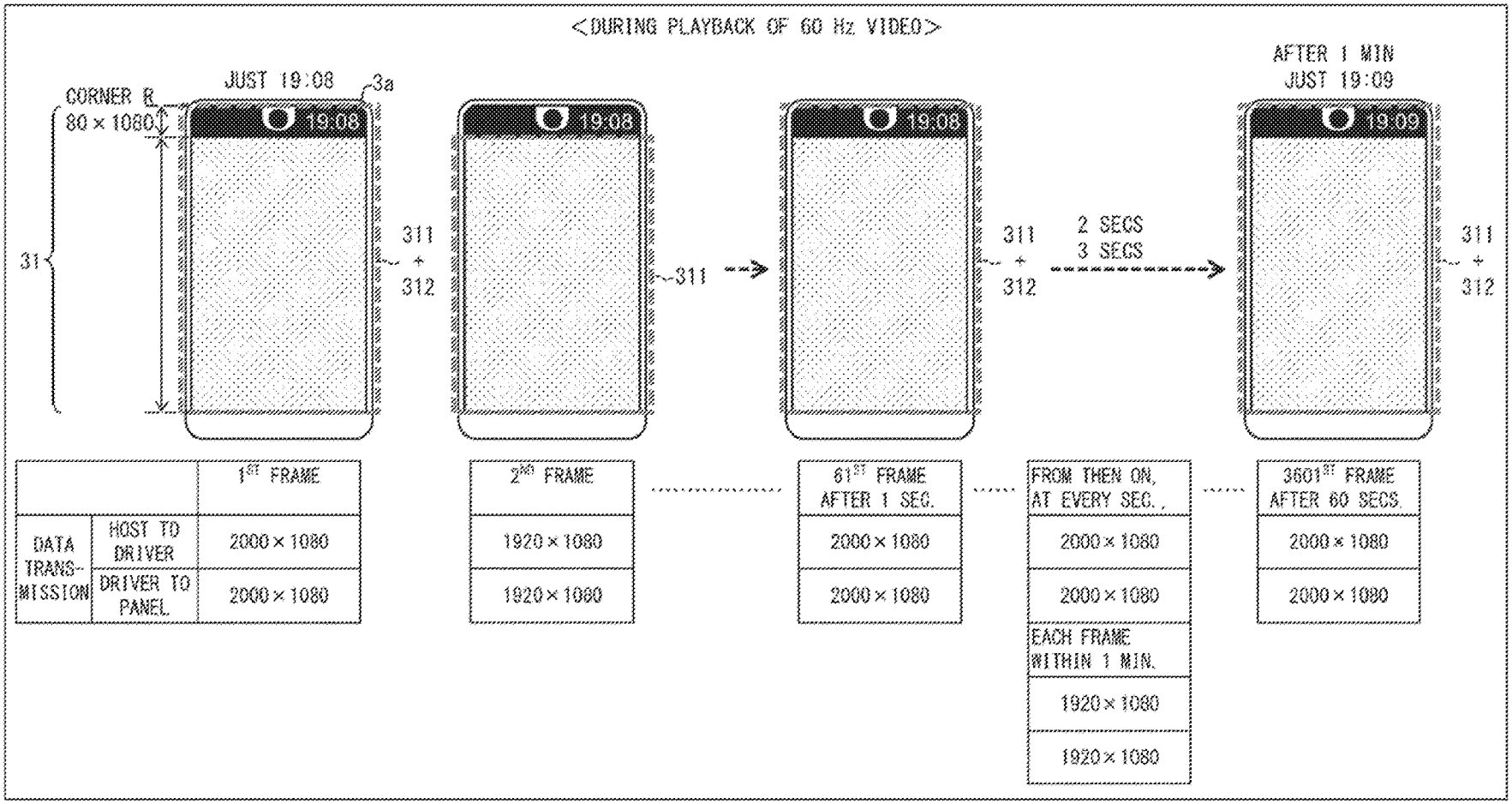
FIG. 4 is a view illustrating an example operation of the smartphone.

FIG. 4 is an explanatory view illustrating an example operation of the smartphone 3*a* of FIG. 3. Note that preconditions (e.g., what kind of video is displayed) other than a control process are identical to those of FIG. 2. Furthermore, the processes similar to those of FIG. 2 are carried out with respect to all frames but a 61st frame, the following description focuses on a process for the 61st frame.

(61st Frame (One Second after Disclosed Time))

The host 2 switches the data, which is to be transmitted to the driver 32*a*, to entire screen data. The driver 32*a* transfers, to the LCD panel 31, the entire screen data thus received. This causes the entire screen of the LCD panel 31 to be refreshed. Note that, as has been described in Embodiment 1, content of a video, displayed on the extended region 312, is not changed, in the 61st frame, from those of the first through 60th frames. According to Embodiment 2, however, in order to prevent the LCD panel 31 from being burnt in, the entire screen inclusive of the extended region 312 is refreshed.

Effects of Embodiment 2

With the configuration of Embodiment 2, as in Embodiment 1, a video displayed on the main region 311 is refreshed on a frame basis (every 1/60 seconds). However, a video, displayed on the extended region 312, is refreshed on a basis of 60 frames (every second). This makes it possible to keep, to the minimum, a refresh rate for the extended region 312. It is therefore possible to reduce power consumption of the LCD panel 31, in comparison with a configuration in which an entire screen is refreshed in synchronization with the refresh rate at which the main region 311 is refreshed.

Further, the host 2 has only to transmit entire screen data every second. During the other period of time, the host 2 has only to transmit partial screen data. This allows a reduction in data to be transmitted from the host 2 as well.

Embodiment 3

Embodiments 1 and 2 each have discussed an example in which a refresh rate for an extended region 312, which is provided as a fixed region, is set lower than that for a main region 311 which is also provided as a fixed region. In contrast, according to Embodiment 3 of the present invention, a region, which is to be refreshed at a low refresh rate, can be varied depending on content of image data to be displayed.

In Embodiment 3, members having identical functions as those of Embodiments 1 and 2 are given identical reference numerals, and their description will be omitted.

Figure 5:
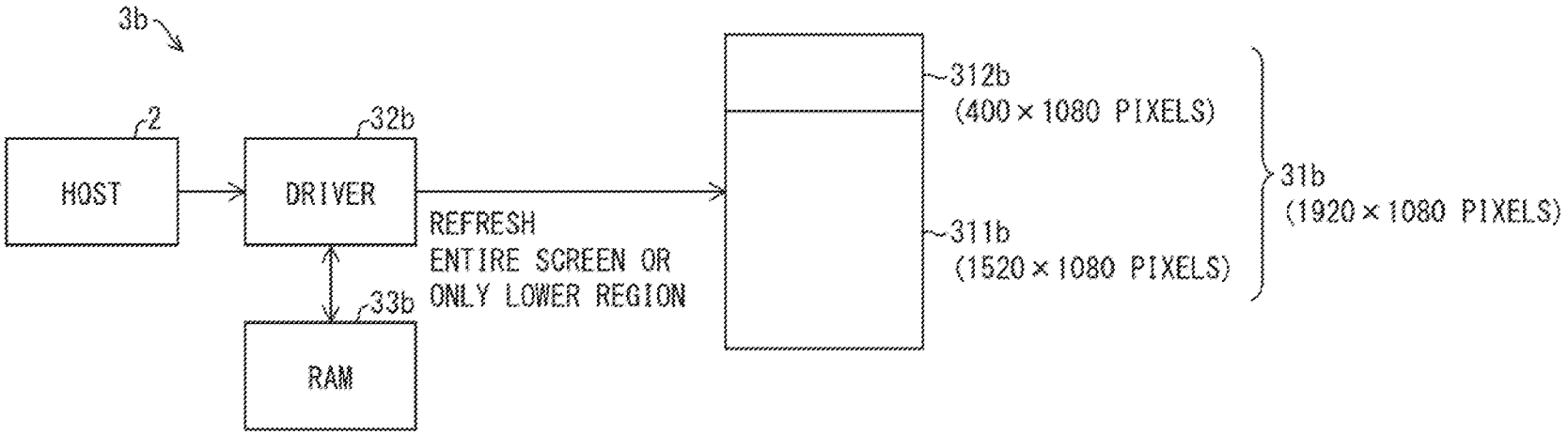
FIG. 5 is an explanatory block diagram illustrating a configuration of a smartphone in accordance with Embodiment 3 of the present invention.

FIG. 5 is a block diagram illustrating a configuration of a smartphone 3*b* of Embodiment 3. The smartphone 3*b* of Embodiment 3 differs from those of Embodiments 1 and 2 in terms of the number of pixels of an LCD panel. The smartphone 3*b* of Embodiment 3 includes a driver 32*b* and a RAM 33*b*. Note, however, that smartphone 3*b* of Embodiment 3 can include no RAM 33*b* and instead be configured so that the driver 32*b* directly transfers data received from the host 2 to the LCD panel 31*b* so as to refresh a video, as with Embodiment 2.

(Operation of Smartphone 3)

Figure 6:
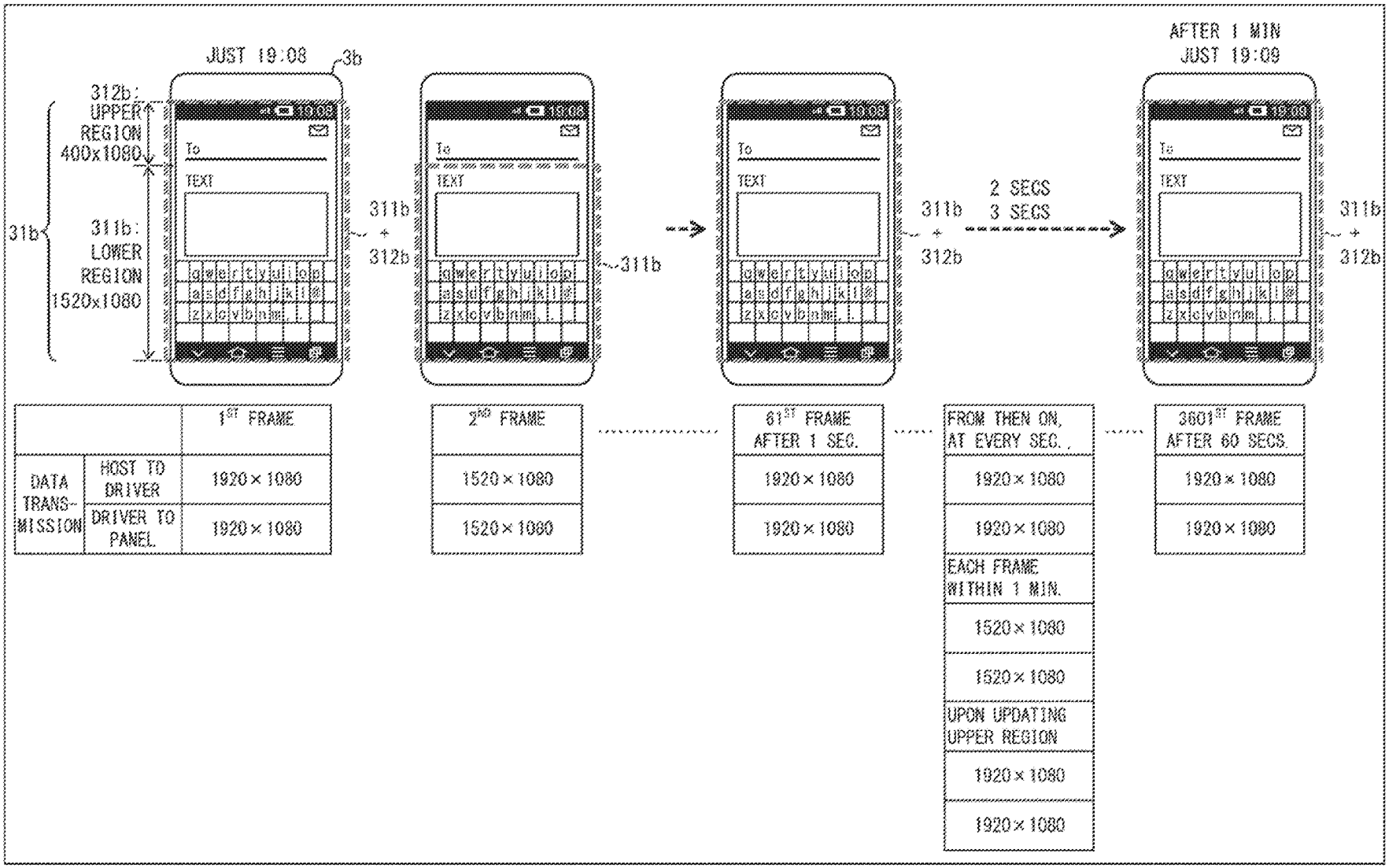
FIG. 6 is a view illustrating an example operation of the smartphone of Embodiment 3.

FIG. 6 is an explanatory view illustrating an example operation of the smartphone 3*b* in accordance with Embodiment 3. According to the example operation, a user interface (UI) for use with an email application program is displayed in the main region 311 of a display screen. Of the display screen, content of a video, in an upper region 312*b* (display size: 400×1080 pixels), is less frequently changed than in a lower region 311*b* (display size: 1520×1080 pixels). As such, a refresh rate for the upper region (partial region) is set lower than the lower region (region other than the partial region). Note that how to determine which region is to be refreshed at a low refresh rate can be determined, in advance, depending on a video to be displayed. Note also that the LCD panel 31 of Embodiment 3 includes no extended region, and therefore exemplifies the LCD panel 31*b* having an entire screen whose display size is 1920×1080 pixels.

In Embodiment 3 as well, the smartphone 3*b* carries out processes similar to those of FIG. 2. That is, in a first frame, the host 2 transmits entire screen data to the driver 32*b*. The driver 32*b* transfers, to the LCD panel 31*b*, the entire screen data thus received. In a subsequent second frame, the host 2 transmits, to the driver 32*b*, partial screen data (corresponding to a lower region of the display screen). The driver 32*b* transfers, to the LCD panel 31*b*, the partial screen data thus received. From then on, a process similar to that for the second frame is repeated up to a 60th frame unless content of a video displayed on the upper region is changed.

In a 61st frame, the host 2 transmits entire screen data to the driver 32*b*. The driver 32*b* transfers the entire screen data thus received to the LCD panel 31*b*. Note that in a case where the driver 32*b* includes the RAM 33*b*, the host 2 can transmit the partial screen data to the driver 32*b*. In this case, the driver 32*b* refreshes the entire screen with use of the entire screen data stored in the RAM 33*b*.

From then on, processes similar to those of the second to 61st frames are performed every second, and one minute after the process for the first frame, a 3601st frame of the video is displayed. Note that in a case where there is no change in content of a video displayed on the upper region, the entire screen is refreshed every second. However, in a case where there is any change in content of a video displayed on the upper region, the host 2 obtains entire screen data that reflects the change at the timing at which the change has occurred, and transmits the data to the driver 32*b*. As such, the entire screen can be refreshed at any timing within one second after previous refreshing.

Effects of Embodiment 3

It is possible to effectively reduce power consumption of the LCD panel 31*b* in accordance with displayed content (content of displayed data). For example, in a case where a video a large part of which content is less frequently changed is displayed, power consumption of the LCD panel 31*b* can be considerably reduced by refreshing the large part of the video at a lower refresh rate.

Modification

Embodiments 1 through 3 each employ, as an example, the smartphones 3, 3*a*, and 3*b*, respectively. However, an embodiment of the present invention is applicable to any display device other than the smartphones 3, 3*a*, and 3*b*. Embodiments 1 through 3 each have discussed an example in which the display panel is realized by the LCD panels 31 and 31*b*. However, the display panel is not limited to the LCD panels 31 and 31*b* and can be any panel that allows (i) a certain region to be refreshed at a lower refresh rate than in a region other than the certain region and (ii) an ultimate reduction in power consumption.

[Software Implementation Example]

A host 2 and drivers 32, 32*a*, and 32*b* can be realized by a logic circuit (hardware) provided in an integrated circuit (IC chip) or the like or can be alternatively realized by software as executed by a central processing unit (CPU).

In the latter case, the host 2 and the drivers 32, 32*a*, and 32*b* each include a CPU that executes instructions of a program that is software realizing the foregoing functions; a read only memory (ROM) or a storage device (each referred to as "storage medium") in which the program and various kinds of data are stored so as to be readable by a computer (or a CPU); and a random access memory (RAM) in which the program is loaded. An object of the present invention can be achieved by a computer (or a CPU) reading and executing the program stored in the storage medium. Examples of the storage medium encompass "a non-transitory tangible medium" such as a tape, a disk, a card, a semiconductor memory, and a programmable logic circuit. The program can be made available to the computer via any transmission medium (such as a communication network or a broadcast wave) which allows the program to be transmitted. Note that the present invention can also be achieved in the form of a computer data signal in which the program is embodied via electronic transmission and which is embedded in a carrier wave.

[Recap]

A display device (smartphones 3, 3*a*, and 3*b*) in accordance with a first aspect of the present invention includes: a display panel (LCD panels 31 and 31*b*); an obtaining section (host 2) configured to obtain image data which is to be supplied to the display panel; and a display processing section (drivers 32, 32*a*, and 32*b*) configured to transmit, to the display panel, the image data obtained by the obtaining section so as to refresh a video which is displayed by the display panel, the display processing section being configured to refresh a video, displayed on a partial region (extended region 312 and an upper region 312*b*) of the display panel, at a refresh rate lower than that at which the display processing section refreshes data displayed on a region other than the partial region (main region 311 and a lower region 311*b*).

The configuration allows a reduction in refresh rate for a video, which is displayed on the partial region of the display panel. This makes it possible to reduce power consumption for refreshing a video in comparison with a configuration in which an entire region of a display panel is refreshed at an identical refresh rate.

In a second aspect of the present invention, a display device may be configured such that in the first aspect: the obtaining section obtains, at a predetermined cycle, as the image data, one of (i) entire screen data corresponding to both the partial region and the region other than the partial region and (ii) partial screen data that does not correspond to the partial region but corresponds to the region other than the partial region; and the display processing section sequentially transmits, to the display panel, the entire screen data or the partial screen data obtained by the obtaining section.

With the configuration, the image data, obtained at a predetermined cycle, is the entire screen data or the partial screen data. By sequentially transmitting the image data to the display panel, the region other than the partial region is refreshed for each transmission, whereas the partial region is refreshed only when the entire screen data is obtained. This makes it possible to reduce a refresh rate for the partial region of the display panel, in comparison with the region other than the partial region.

In a third aspect of the present invention, a display device may be configured such that in the second aspect, the obtaining section obtains (i) the partial screen data during a period of time in which content of a video displayed on the partial region is not changed and (ii) the entire screen data at a timing at which the content of the video displayed, on the partial region, is changed.

With the configuration, the entire screen data is obtained at a timing at which content of a video displayed on the partial region is changed. Therefore, such a change in content can reflect on a display of the partial region. Furthermore, since the partial screen data is obtained during a period in which content of a video, displayed on the partial region, is not changed, it is possible to keep to the bare minimum a rate at which a process of obtaining the entire screen data is carried out and a refresh rate at which a process of refreshing an entire screen inclusive of both of the partial region and the region other than the partial region, which process accompanies the process of obtaining the entire screen data, is carried out.

In a fourth aspect of the present invention, a display device may be configured in a second or third aspect, to further include a storage section (RAM 33) configured to store therein the entire screen data and the partial screen data, which are obtained by the obtaining section, the display processing section being configured to refresh the video which is displayed on the partial region with use of the entire screen data stored in the storage section, in a case where the obtaining section obtains the partial screen data after a predetermined period of time has elapsed from previous refreshing of a video displayed on the partial region.

With the configuration, in a case where the obtaining section obtains the partial screen data after a predetermined period of time has elapsed from previous refreshing of a video displayed on the partial region, the video displayed on the partial region is refreshed with use of the entire screen data stored in the storage section. This makes it possible to avoid, for example, a problem that a video displayed on the partial region has not been refreshed for a longer period and consequently, the display panel is burnt in.

In a fifth aspect of the present invention, a display device may be configured such that in any one of the first to fourth aspects, the partial region is a region which is variable in accordance with content of the image data.

With the configuration, it is possible to effectively reduce power consumption of the display panel in accordance with content of image data. For example, in a case where a video a large part of which content is less frequently changed is displayed, power consumption of the display panel can be considerably reduced by refreshing the large part of the video at a lower refresh rate.

ADDITIONAL REMARKS

An aspect of the present invention is not limited to the embodiments, but can be altered by a skilled person in the art within the scope of the claims. The present invention also encompasses, in its technical scope, any embodiment derived by combining technical means disclosed in differing embodiments. Further, it is possible to form a new technical feature by combining the technical means disclosed in the respective embodiments.

REFERENCE SIGNS LIST

2 Host (obtaining section)
3, 3*a*, 3*b* Smartphone (display device)
31, 31*b* LCD panel (display panel)
32, 32*a*, 32*b* Driver (display processing section)
33 RAM (storage section)
311 Main region (other region)
312 Extended region (partial region)

The invention claimed is:

1. A display device comprising:
a display panel;
a memory that stores instructions; and
a processor that executes the instructions stored in the memory,
the processor carrying out the following:
obtaining image data which is to be supplied to the display panel; and
transmitting, to the display panel, the image data obtained so as to refresh a video which is displayed by the display panel,
the processor refreshing a video, displayed on a partial region of the display panel, at a refresh rate lower than that at which the processor refreshes a video displayed on a region other than the partial region,
the partial region including a first end part of the display panel,
the region other than the partial region including a second end part of the display panel,
in a case where the processor refreshes the video only in the region other than the partial region, the processor refreshing the image starting from a refresh start location in the second end part,
in a case where the processor refreshes an entire video displayed in both the partial region and the region other than the partial region, the processor refreshing the entire video, up to the first end part, starting from the refresh start location.

2. The display device as set forth in claim 1, wherein:
the processor
obtains at a predetermined cycle, as the image data, one of (i) entire screen data corresponding to both the partial region and the region other than the partial region and (ii) partial screen data that does not correspond to the partial region but corresponds to the region other than the partial region; and
sequentially transmits, to the display panel, the entire screen data or the partial screen data obtained.

3. The display device as set forth in claim 2, wherein the processor obtains (i) the partial screen data during a period of time in which content of a video displayed on the partial region is not changed and (ii) the entire screen data at a timing at which the content of the video displayed, on the partial region, is changed.

4. The display device as set forth in claim 2, further comprising:
a storage configured to store therein the entire screen data and the partial screen data, which are obtained by the processor,
the processor being configured to refresh the video which is displayed on the partial region with use of the entire screen data stored in the storage, in a case where the processor obtains the partial screen data after a predetermined period of time has elapsed from previous refreshing of a video displayed on the partial region.

5. The display device as set forth in claim 1, wherein the partial region is a region which is variable in accordance with content of the image data.

* * * * *